US005531141A

United States Patent [19]

Gilbert, Jr.

[11] Patent Number: 5,531,141

[45] Date of Patent: Jul. 2, 1996

[54] DRAIN NUT PLIERS

[76] Inventor: David S. Gilbert, Jr., 110 Rock Run Rd., Elizabeth, Pa. 15037

[21] Appl. No.: 453,989

[22] Filed: May 30, 1995

[51] Int. Cl.[6] ..... B25B 7/02

[52] U.S. Cl. ..... 81/426.5; 81/424.5

[58] Field of Search ..... 81/426.6, 424.5, 81/419, 186, 421, 418

[56] References Cited

U.S. PATENT DOCUMENTS

| | | | |
|---|---|---|---|
| 93,179 | 8/1869 | Crain . | |
| 894,626 | 7/1908 | Givens . | |
| 1,363,316 | 12/1920 | Dudek . | |
| 1,367,362 | 2/1921 | Earnhart | 81/424.5 |
| 1,641,152 | 9/1927 | Burleigh . | |
| 1,692,911 | 11/1928 | Vaughn | 81/426.5 |
| 2,495,308 | 1/1950 | Amigone | 81/426.5 |
| 2,607,248 | 8/1952 | Vlasak et al. | 81/3.44 |
| 2,625,066 | 1/1953 | Petty | 81/3.44 |
| 2,682,797 | 7/1954 | Jensen . | |
| 2,711,110 | 6/1955 | Brame | 81/58.1 |
| 2,750,826 | 6/1956 | Lisbon . | |
| 2,757,564 | 8/1956 | Reaves | 81/58.2 |
| 2,774,270 | 12/1956 | Daniel . | |
| 2,801,561 | 8/1957 | Bonner . | |
| 2,882,775 | 4/1959 | Rank et al. | 81/414 |
| 2,990,213 | 6/1961 | Kolacinski | 294/118 |
| 3,082,652 | 3/1963 | Marti | 81/415 |
| 3,109,334 | 11/1963 | Miranda | 81/100 |
| 3,192,805 | 7/1965 | Manning | 81/414 |
| 3,817,126 | 6/1974 | Koebbeman | 81/3.44 |
| 4,232,573 | 11/1980 | Dace, Jr. | 81/405 |
| 4,296,655 | 10/1981 | Tesoro | 81/405 |
| 4,563,833 | 1/1986 | Aucoin | 81/426.5 |
| 5,048,378 | 9/1991 | Nikolas | 81/124.2 |
| 5,176,049 | 1/1993 | Neff | 81/360 |
| 5,388,479 | 2/1995 | Sroka | 81/58.2 |

*Primary Examiner*—Bruce M. Kisliuk
*Assistant Examiner*—Joni B. Danganan
*Attorney, Agent, or Firm*—Webb Ziesenheim Bruening Logsdon Orkin & Hanson

[57] ABSTRACT

Cross pivoted handled pliers are disclosed having two elongated members joined together by a fixed pivot pin, and each having an arcuate jaw portion and a handle portion. The arcuate jaw portions have circular grooves and recesses therein to receive ribs and ears on an outer surface of a drain nut. The arcuate jaw portions additionally have a plurality of spaced teeth arrays formed on inner surfaces thereof which correspond to drain nuts of various diameters.

14 Claims, 7 Drawing Sheets

DRAIN NUT PLIERS

BACKGROUND OF THE INVENTION

1. Field of the Invention

This invention relates to pliers and, more particularly, to pliers which are usable to handle various types of round workpieces, particularly, drain nuts.

2. Description of the Prior Art

The component parts of drain-waste systems are generally assembled with drain nuts, a typical example of which is shown in FIG. 6. The drain lines of the drain-waste systems are normally installed in confined areas in sink cabinets, and under lavatory cabinets and service counters. In addition, water service lines, waste disposal units and other miscellaneous piping may be located in the vicinity of the drain line. Consequently, access to the drain lines and drain nuts may be restricted or awkward.

A variety of hand tools have been utilized with the installation and handling of drain lines and drain nuts. A pliers-type hand tool is commonly used to handle drain nuts and other drain-waste system components. See, for example, the tools shown in U.S. Pat. Nos. 2,682,797; 2,750,826; 2,990,213; 3,109,334; and 5,176,049.

However, the use of these prior art tools to install or remove drain nuts is disadvantageous for numerous reasons. First, the dissimilar opposing jaw areas do not permit application of an equal or uniform force to drain nuts of various sizes and shapes. In addition, the squeezing action may damage plastic or thin-walled metal drain nuts. Further, these tools do not have curved grooves on the inner jaw surfaces to receive various protrusions which exist on many common drain nuts. Finally, these tools have a wide profile which requires a considerable amount of space for use.

A variety of plier type hand tools have been developed for working on round workpieces, such as pipes and jar caps. See, for example, U.S. Pat. Nos. 3,817,126; 2,625,066; 2,607,248; 1,641,152; 1,363,316; 894,626; and 93,179. However, these specialized pliers do not accommodate the rib and ear structures found on many drain nuts.

Accordingly, it is an object of the present invention to provide pliers for handling drain nuts which can be used to tighten or loosen the drain nut without having to invert the pliers. It is a further object of the invention to provide pliers which apply a substantially uniform force to drain nuts of various sizes and shapes without mechanical adjustment. It is an additional object of the present invention to provide pliers which have arcuate jaws with grooves and recesses to handle drain nuts with ribs and ears on an outer surface thereof. It is another object of the invention to provide pliers which can be easily used in a confined environment without damage to the drain nut itself.

SUMMARY OF THE INVENTION

The present invention provides a cross pivoted handled hand tool for drain nuts which includes two cross pivoted elongated members each having an arcuate jaw and a handle at opposite ends thereof and a pivot pin for pivotally coupling the elongated members together. The inner surface of each arcuate jaw has a plurality of teeth arrays which engage a drain nut at a plurality of positions about the periphery of the drain nut. A plurality of grooves and a recess are provided on each jaw and are configured to receive a plurality of ribs and ears on the outer surface of a drain nut. The hand tool of my invention may grasp drain nuts of various diameters without mechanical adjustment.

DESCRIPTION OF THE PREFERRED EMBODIMENTS

Figure 1:
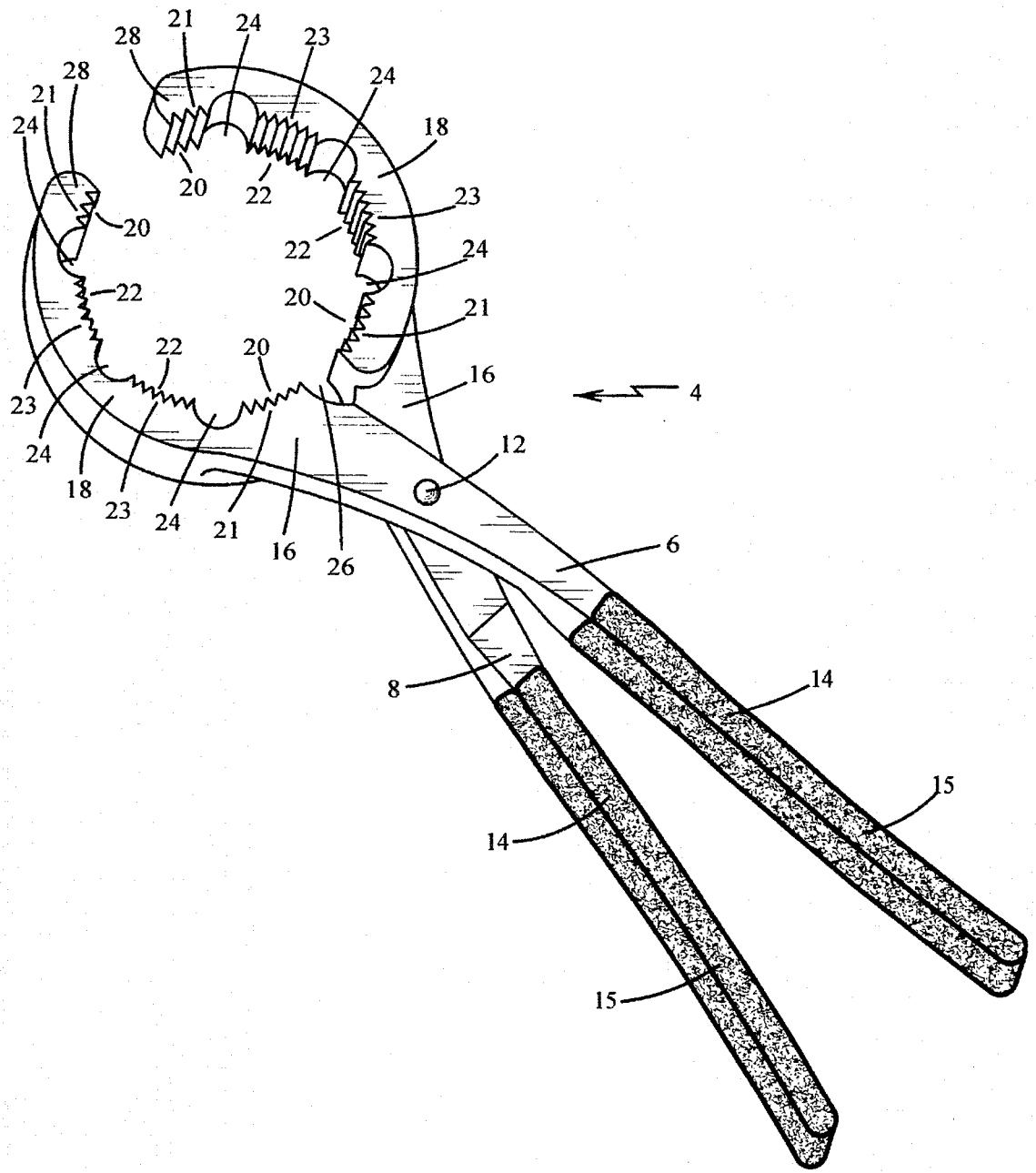
FIG. 1 is a perspective view of the pliers according to the present invention.

Referring now to FIGS. 1–10, there is shown cross pivoted handle pliers 4 for handling drain nuts 30 as shown in FIGS. 7–10. The pliers 4 include a first elongated member 6 and a second elongated member 8. The first ends of the elongated members 6, 8 are formed as arcuate jaws 18, and the second ends are formed as handles 14. The handles 14 may have plastic grips 15 thereabout which permit comfortable control of the pliers 4.

The first elongated member 6 and second elongated member 8 are pivotably coupled together by a pivot pin 12. The fixed pivot pin 12 is centered on the width of the pliers 4 permitting proper balance and movement of the pliers 4. The arcuate jaws 18 of the first and second elongated members 6, 8 are oriented to securely grasp a drain nut 30 therebetween. The first and second elongated members 6, 8 may be identical to one another to reduce manufacturing costs. The pliers 4 may be made from drop-forged steel or reinforced plastic.

The pliers 4 are usable to tighten or loosen drain nuts 30 by moving the handles 14 toward one another thereby causing the arcuate jaws 18 to move toward one another grasping a drain nut 30 therein. The drain nut 30 may then be rotated either clockwise or counterclockwise without inverting the pliers 4. Moving the handles 14 away from one another causes the arcuate jaws 18 to move away from one another and permits the pliers 4 to be removed from or placed around a drain nut 30.

Figure 2:
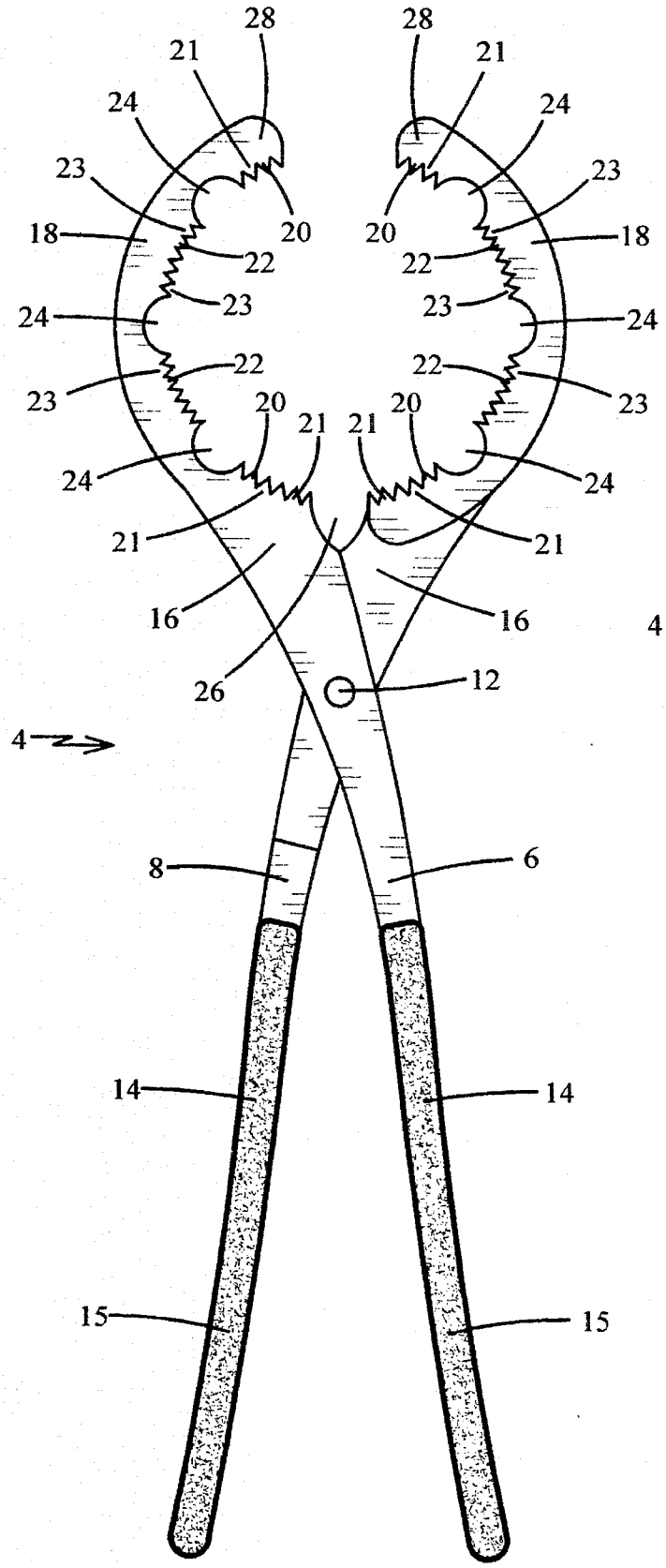
FIG. 2 is a top view of the pliers shown in FIG. 1.
Figure 3:
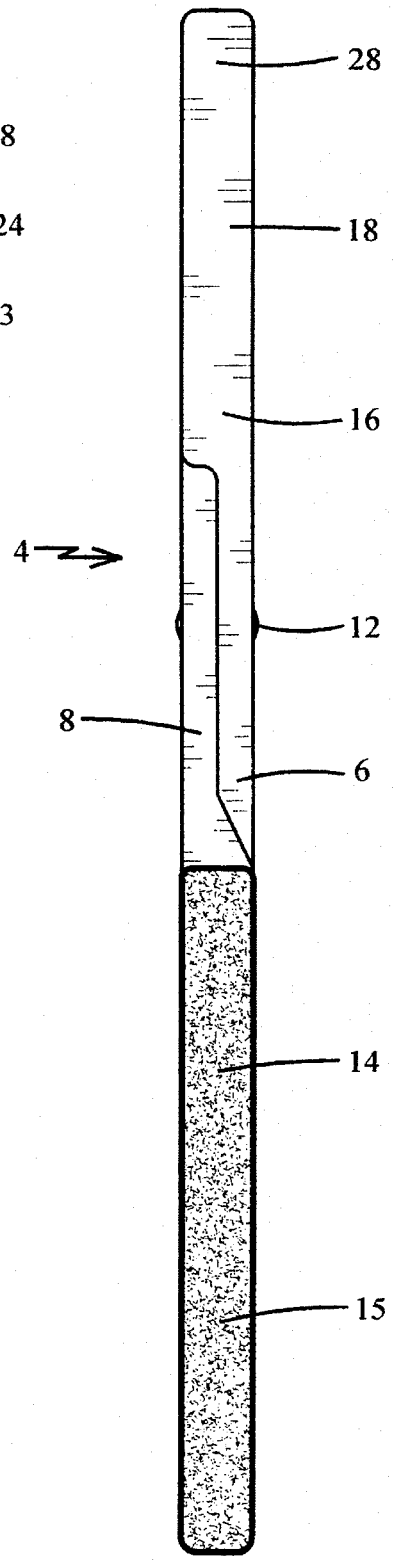
FIG. 3 is a side view of the pliers shown in FIG. 1.
Figure 4:
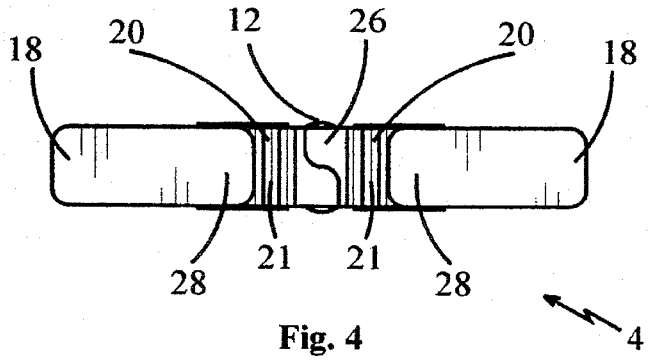
FIG. 4 is a front view of the pliers shown in FIG. 1.
Figure 5:
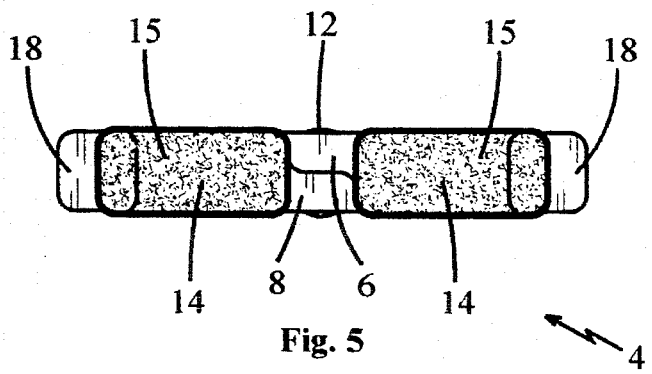
FIG. 5 is a rear view of the pliers shown in FIG. 1.
Figure 6:
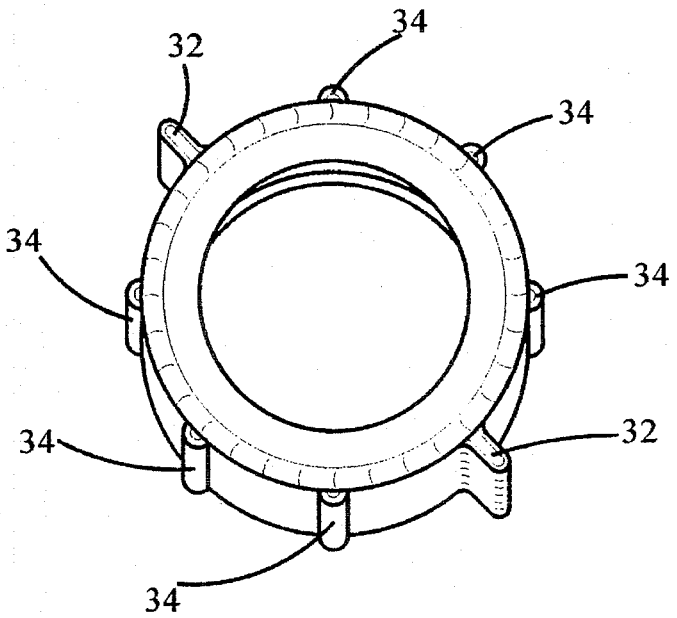
Fig. 6 Prior Art
FIG. 6 is a perspective view of a conventional drain nut having ears and ribs.
Figure 9:
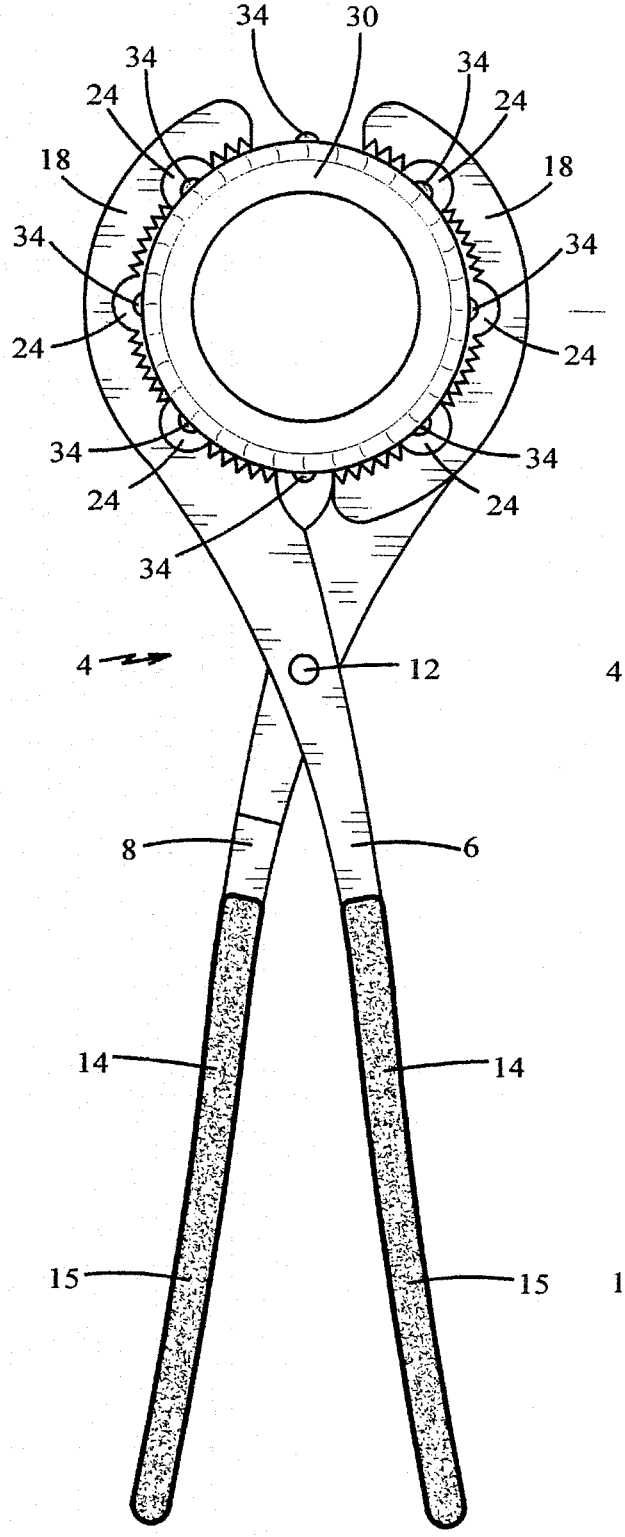
FIG. 9 is a top view of the pliers shown in FIG. 1 grasping a drain nut having ribs.
Figure 10:
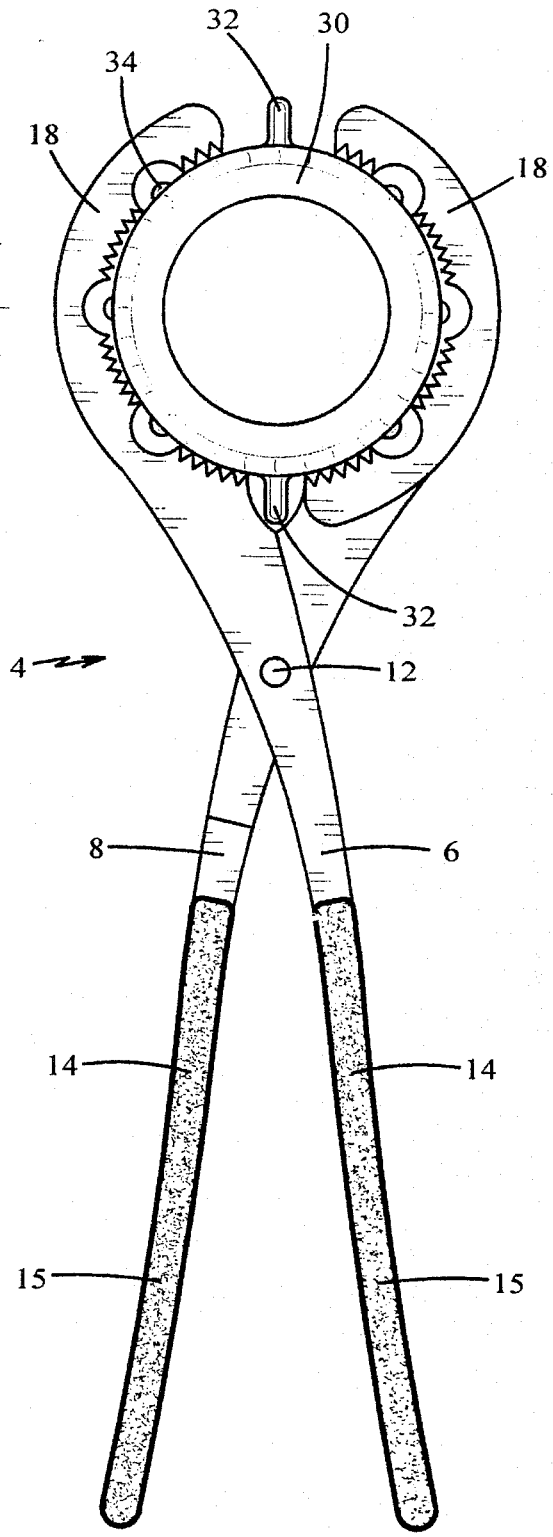
FIG. 10 is a top view of the pliers shown in FIG. 1 grasping a drain nut having ears and ribs.

The arcuate jaws 18 are formed substantially as semicircles as shown in FIGS. 1 and 2. The arcuate jaws 18 have a plurality of first teeth arrays 20 and second teeth arrays 22 formed on the inner surfaces thereof to grip a drain nut 30. Each first teeth array 20 is separated from an adjoining second teeth array 22 by a circular groove 24 which extends into each jaw 18 beyond the depth of the teeth as shown in FIGS. 1–2. As shown in FIG. 9, the circular grooves 24 are adapted to receive ribs 34 which may be formed on an outer surface of a drain nut 30 and prevent the arcuate jaws 18 from deforming or wearing down the ribs 34.

Each of the teeth arrays 20, 22 contains a plurality of teeth 21, 23 which securely grip the outer surface of a drain nut 30 at spaced positions around the circumference of the drain nut 30. Furthermore, the first teeth arrays 20 define a first circular profile and the second teeth arrays 22 define a second circular profile. The first circular profile corresponds to the outer surface of a first drain nut 30 and the second circular profile corresponds to the outer surface of a second different sized drain nut 30, wherein the first drain nut 30 has a larger diameter than the second drain nut 30. Providing the pliers 4 with teeth arrays 20, 22 which correspond to different profiles enables the pliers 4 to securingly grasp different sized drain nuts 30 without mechanical adjustment.

Figure 7:
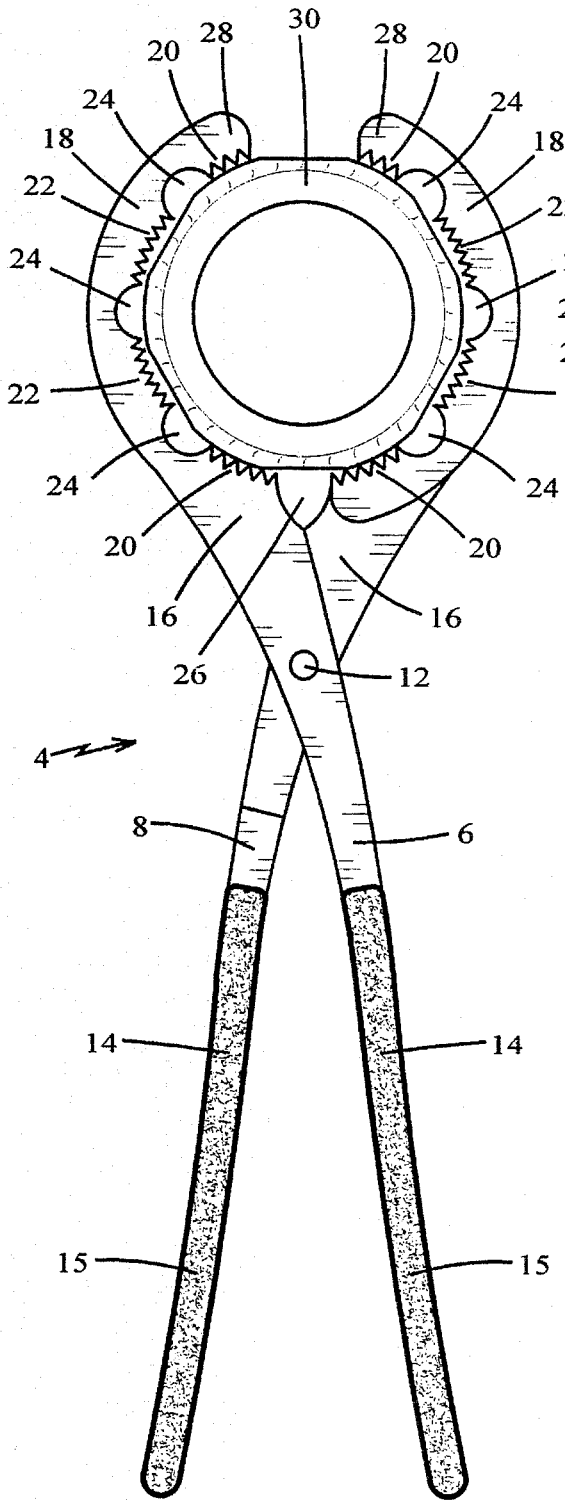
FIG. 7 is a top view of the pliers shown in FIG. 1 grasping a drain nut.
Figure 8:
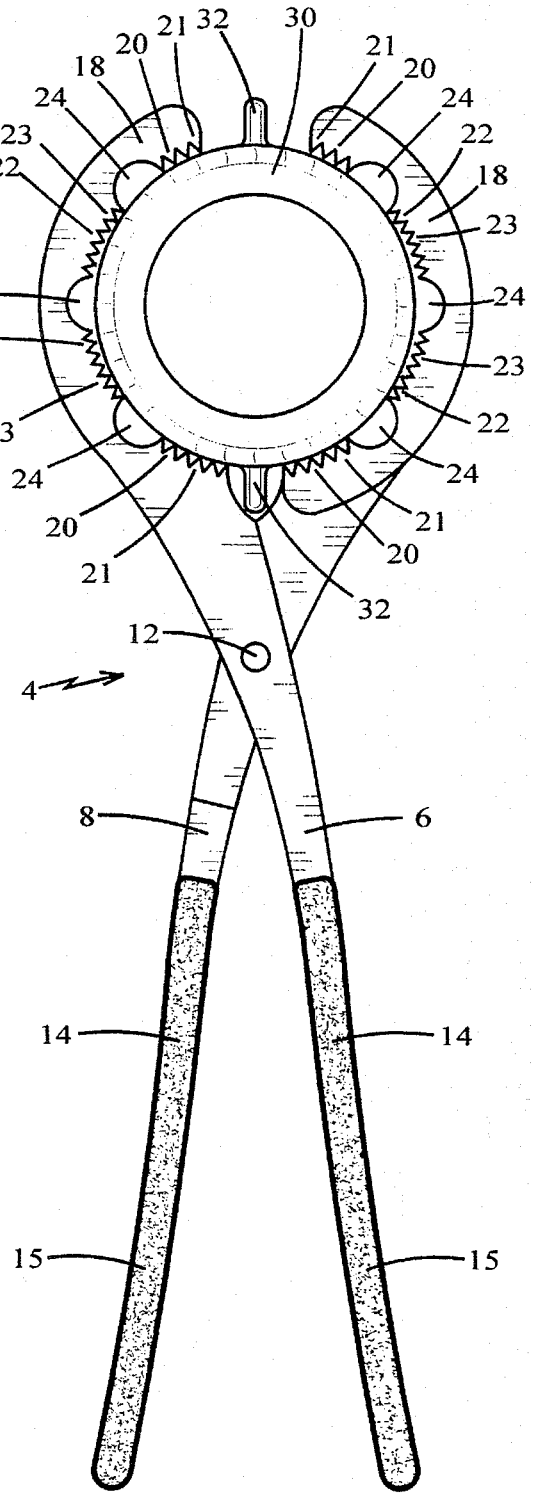
FIG. 8 is a top view of the pliers shown in FIG. 1 grasping a drain nut having ears.

The heels 16 of the two arcuate jaws 18 define a recess 26 therebetween. The recess 26 and open region between the tips 28 of the arcuate jaws 18 receive ears 32 of the drain nuts 30 as shown in FIG. 8. In addition, the pliers 4 may grasp drain nuts 30 of various shapes including circular drain nuts as shown in FIG. 8 or substantially circular drain nuts 30 having six flat surfaces imposed thereon as shown in FIG. 7.

The grooves 24, recess 26, tips 28 and teeth arrays 20, 22 permit the arcuate jaws 18 to grasp a drain nut 30 without damaging the ribs 34 or ears 32 on the drain nut 30. The circular profiles defined by teeth arrays 20, 22 permit the arcuate jaws 18 to apply a substantially uniform force at four diametrically opposed positions on the outer surface of the drain nut 30 and enable proper tightening or loosening of the drain nut 30. This distribution of force enables the pliers 4 to tighten or loosen the drain nut 30 without inverting the pliers 4 or causing damage to drain nuts 30 made of plastic or thin-walled metal.

The pliers 4 are constructed with a narrow profile which requires a minimal amount of space in the working area. The pliers 4 have an overall length of approximately 9½ inches and a thickness of approximately 7/16 of an inch. The arcuate jaws 18 have a width of approximately 3 inches and the handles 14 are spread approximately 2¼ inches when a large diameter drain nut 30 is grasped within the arcuate jaws 18.

Figure 11:
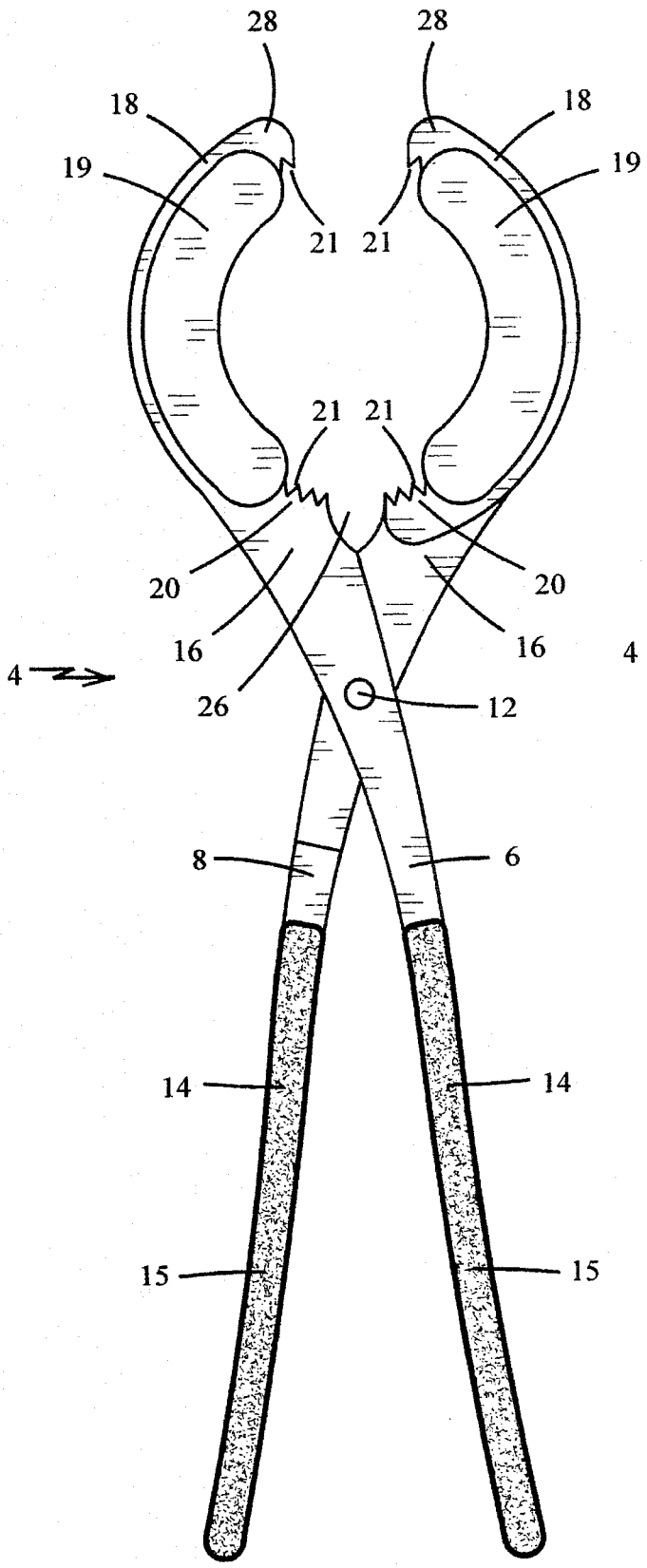
FIG. 11 is a top view of a second embodiment of the pliers according to the present invention.
Figure 12:
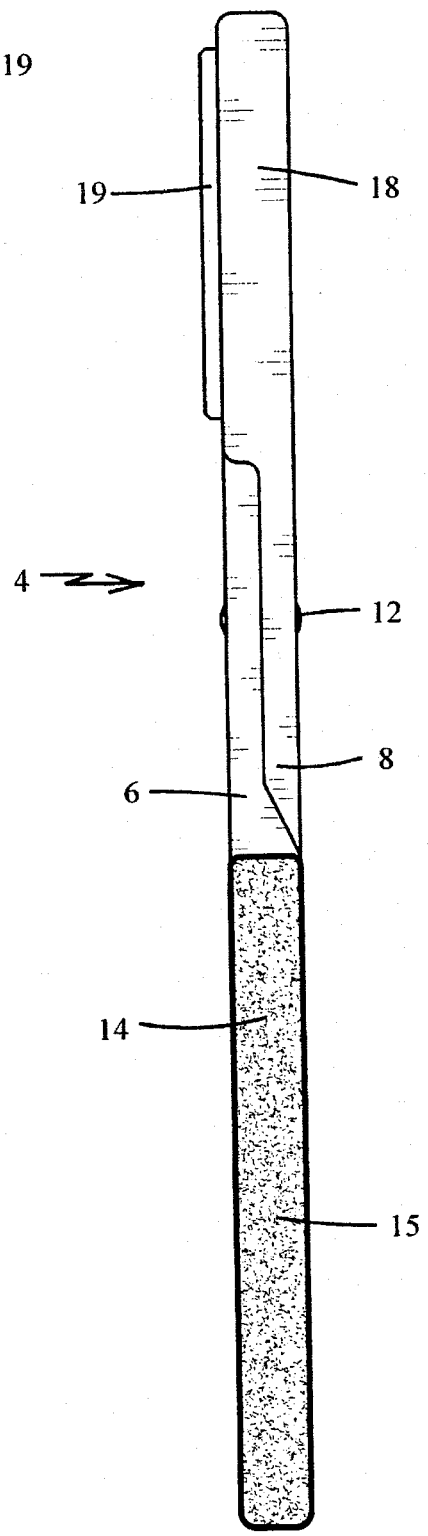
FIG. 12 is a side view of the pliers shown in FIG. 11.
Figure 13:
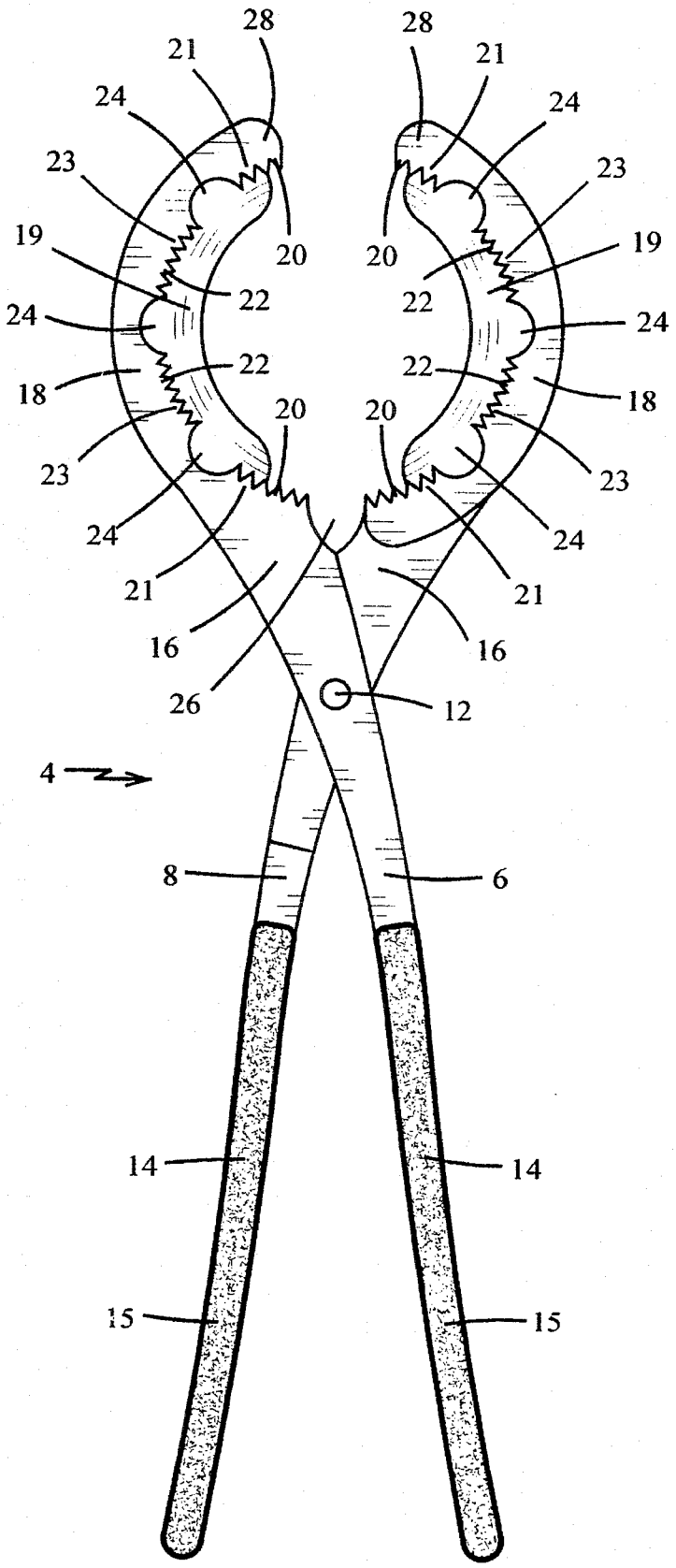
FIG. 13 is a bottom view of the pliers shown in FIG. 11.

A second embodiment of the pliers 4 is shown in FIGS. 11–13. In particular, guide plates 19 are mounted on corresponding sides of the arcuate jaws 18. The guide plates 19 may be either detachably mounted or welded onto the arcuate jaws 18. The guide plates 19 provide stability when tightening or loosening a drain nut 30 by engaging an end portion of the drain nut 30 to properly align the arcuate jaws 18 with the drain nut 30.

Having described above the presently preferred embodiments of the present invention, it is to be understood that the invention may be otherwise embodied within the scope of the appended claims.

I claim:

1. A hand tool for handling a workpiece, comprising:

a first elongated member having an arcuate jaw at a first end and a handle portion at a second end;

a second elongated member having an arcuate jaw at a first end and a handle portion at a second end; and a pivot pin for pivotally coupling said first elongated member to said second elongated member;

wherein an inner surface of each said arcuate jaw includes a plurality of teeth thereon which are adapted to engage the workpiece at a plurality of positions around the circumference of the workpiece, and each said arcuate jaw further including a plurality of grooves positioned on said jaw extending away from said inner surface into said jaw, said plurality of grooves separating said plurality of teeth into spaced teeth arrays, each said teeth array including a plurality of said teeth, wherein tips of said teeth of each said array lie on a concave, arcuate curve, wherein adjacent teeth arrays on one arcuate jaw are separated by one said groove, and wherein said tips of said teeth of a first set of said teeth arrays defines a first circular profile and said tips of said teeth of a second set of said teeth arrays defines a second circular profile.

2. The hand tool of claim 1 wherein the workpiece is a drain nut having ribs, whereby said plurality of grooves are adapted to receive the ribs of the drain nut.

3. The hand tool of claim 1 wherein said first and second elongated members are identical in shape.

4. The hand tool of claim 3 wherein each said groove is arcuate in cross section.

5. The hand tool of claim 1 wherein said first set of teeth arrays include teeth arrays adjacent a tip and heel of said first and second arcuate jaws, and said second set of teeth arrays include teeth arrays adjacent said first set of teeth arrays.

6. The hand tool of claim 5 wherein a diameter of said first circular profile is larger than a diameter of said second circular profile.

7. The hand tool of claim 6 wherein said tips and said heels of the first and second arcuate jaws are spaced from each other when said hand tool is engaging a workpiece wherein said spaces are adapted to receive ears on the outer surface of the workpiece.

8. The hand tool of claim 7 further including a guide plate attached to each said arcuate jaw on one side thereof.

9. The hand tool of claim 8 wherein said first and second elongated members are substantially identical in shape.

10. The hand tool of claim 9 wherein each said arcuate jaw includes four said teeth arrays and three said grooves.

11. A cross pivoted handle plier for a drain nut having a plurality of ribs on an outer surface thereof, comprising:

a first elongated handle member having an arcuate jaw at a first end thereof and a handle portion at a second opposed end thereof;

a second elongated member having an arcuate jaw at a first end thereof and a handle portion at a second opposed end thereof; and a pivot pin for pivotally coupling said first elongated member to said second elongated member;

each said arcuate jaw including a plurality of teeth arrays and a plurality of grooves on an inner surface thereof, wherein adjacent said teeth arrays are separated by one said groove, said grooves adapted to receive the ribs of the drain nut, wherein each said teeth array includes a plurality of teeth, wherein tips of said teeth of each said array lie on a concave, arcuate curve wherein said teeth are adapted to engage the drain nut at a plurality of positions around the circumference of the drain nut, and wherein each jaw includes a first and second set of said teeth arrays, said first set includes teeth arrays positioned adjacent a tip and a heel of said jaw, wherein said tips of said teeth of said first set of teeth arrays define a first circular profile, and said second set includes teeth arrays adjacent said teeth arrays of said first set and said tip of said teeth of said second set define a second circular profile, wherein a diameter of said first circular profile is larger than a diameter of said second circular profile, and the tips and heels of said first jaw and second jaw define spaces which correspond to a plurality of ears on the outer surface of the drain nut.

12. The pliers of claim 11 wherein said heels of said jaws are spaced from each other when said plier engages the drain nut, whereby an ear of the drain nut is adapted to be received therebetween.

13. The pliers of claim 12 wherein said tips of said jaws are spaced from each other when said pliers engage the drain nut, whereby an ear of the drain nut is adapted to be received therebetween.

14. The pliers of claim 13 wherein each said arcuate jaw further includes a guide plate attached to one side thereof and extending beyond said inner surface, said guide plate adapted to abut against an end face of the drain nut.

* * * * *

UNITED STATES PATENT AND TRADEMARK OFFICE

CERTIFICATE OF CORRECTION

PATENT NO. : 5,531,141

DATED : July 2, 1996

INVENTOR(S) : David S. Gilbert, Jr.

It is certified that error appears in the above-indentified patent and that said Letters Patent is hereby corrected as shown below:

Claim 11 Line 59 Column 4 "tip" should read --tips--.

Signed and Sealed this

Eighth Day of October, 1996

*Attest:*

Bruce Lehman

BRUCE LEHMAN

*Attesting Officer*

*Commissioner of Patents and Trademarks*